US006205850B1

(12) United States Patent
Wehrman et al.

(10) Patent No.: US 6,205,850 B1
(45) Date of Patent: Mar. 27, 2001

(54) METHOD FOR SETTING TAPPET CLEARANCE

(75) Inventors: Daniel Joseph Wehrman, Fort Loramie, OH (US); Tetsuo Toyama, Rochester Hills, MI (US)

(73) Assignees: Honda of America Mfg., Inc., Marysville, OH (US); Sanyo Machine America Corp., Rochester Hills, MI (US)

( * ) Notice: Subject to any disclaimer, the term of this patent is extended or adjusted under 35 U.S.C. 154(b) by 0 days.

(21) Appl. No.: 09/351,396

(22) Filed: Jul. 13, 1999

(51) Int. Cl.[7] ..... G01M 15/00
(52) U.S. Cl. ..... 73/119 R; 123/90.52; 123/90.45
(58) Field of Search ..... 73/116, 119 R; 123/90.48, 90.52, 90.45, 90.39, 90.1

(56) References Cited

U.S. PATENT DOCUMENTS 3,988,925 * 11/1976 Seccombe et al. ..... 73/119 R
4,393,693 7/1983 Naito .
4,483,185 * 11/1984 Kunzfeld ..... 73/117.2
4,521,863 6/1985 Solaroli .
5,351,413 * 10/1994 Bruner et al. ..... 73/119 R
5,740,769 4/1998 Mori .
5,782,216 * 7/1998 Haas et al. .
6,095,104 * 8/2000 Bolognesi et al. ..... 73/118.1

* cited by examiner

*Primary Examiner*—Eric S. McCall
(74) *Attorney, Agent, or Firm*—Rankin, Hill, Porter & Clark, LLP

(57) ABSTRACT

A method for setting clearance between a tappet screw and a valve wherein the movement of the valve during opening and closing is monitored and used to calculate further linear movement of the tappet screw to provide a desired tappet clearance. In one embodiment, a predetermined imaginary zero point, which falls in a band of linear displacement during closing of the valve, is used to determine a distance the tappet screw must be further moved to provide the desired tappet clearance. In another embodiment, plural valve displacement measurements are taken and the true zero point or valve closed position, and further movement of the tappet screw to provide the desired tappet clearance is determined based upon these plural measurements. In a further embodiment, movement of the valve head is directly monitored and used to set the tappet clearance.

14 Claims, 9 Drawing Sheets

METHOD FOR SETTING TAPPET CLEARANCE

BACKGROUND OF THE INVENTION

1. Field of the Invention

The present invention is generally directed toward manufacturing methods and, more particularly, toward a method for setting a clearance between a rocker arm adjustment screw and an engine valve.

2. Description of Related Art

Tappet clearance is the distance between a bottom surface of an adjustment or tappet screw and an upper surface of a valve. Accurately setting the tappet clearance, which is vital to proper operation of the engine, is time-consuming and labor-intensive. Unfortunately, when the cylinder head is secured on the engine block, the position of the adjustment screws, which much be adjusted to set the tappet clearance, prevents direct visual observation of the tappet clearance.

Accordingly, it is a common practice for an assembler to walk along and manually adjust the tappet clearance with feeler gauges as the engine travels on the assembly line. Unfortunately, this method results in non-repeatable and inconsistent results as the skill of each assembler directly affects the quality of the finished product. Moreover, tilting of the feeler gauges, as may occur in the manual tappet clearance setting method, will naturally produce inconsistent results.

In response to this problem, several solutions have been proposed. One solution is embodied in expired U.S. Pat. No. 3,988,925, the disclosure of which is expressly incorporated herein by reference in its entirety. In the '925 patent, a method for adjusting valve lash or adjustment screw clearance includes positioning the crank shaft in a neutral position, insuring that the valve is closed, turning the adjustment screw toward the valve and engaging the valve stem, and sensing movement of the valve retainer indicative of the valve opening to establish a zero reference. Once the zero reference is established, the direction of rotation of the adjustment screw is reversed until the adjustment screw is at the zero reference. Thereafter, the adjustment screw is reversed further away from the valve a predetermined amount to provide a desired clearance between the screw and the valve stem.

While the method taught in the '925 patent is a good starting point, it suffers from a number of disadvantages. Most importantly, it fails to account for many variables and tolerances present in the mechanical system that are causes for error in the tappet clearance. Accordingly, while results should, theoretically, be repeatable and consistent using the '925 method, in reality the results are inconsistent and provide a source of concern.

In practice, the variables or tolerances that result in tappet clearance errors when using the '925 method are numerous. For example, there is the clearance between the adjustment screw and the valve. This is the clearance that is to be determined and set to a predetermined value. There is also the clearance between the valve and the head. There is the further clearance between the rocker arm and the cam shaft. In the '925 patent, these two last mentioned clearances are assumed to be zero. Unfortunately, these clearances are not zero, are not consistent from engine to engine, and are a source of error which cause inconsistent and non-repeatable results.

Moreover, other variables or sources of error exist in the mechanical system under consideration. There exists a journal clearance between the rocker arm and the rocker shaft. There is also lash (lost motion) in the threaded connection between the screw and the rocker arm. This lost motion can be best understood by visualizing the screw threads engaging one edge of the rocker arm threaded opening when loaded and engaging the opposite edge when not loaded. This vertical displacement is a source of error. There is clearance in the connection between the adjustment screw and the adjustment screw bit, creating lost motion or lash when the direction of bit/screw rotation is reversed. The spring biased valve is under tension when at-rest and under compression during the opening/closing stroke, creating a measurable deflection of tension that is a source of error. There is also clearance between the valve guide and the valve stem, creating initial instability in the tracking of valve retainer and valve movement. Again, there is no means in the system taught by the '925 patent to account for these numerous potential sources of error which may vary from engine to engine. Accordingly, the results derived using the '925 method are less consistent and repeatable than desired.

Therefore, there exists a need in the art for a tappet clearance setting method that provides consistent, repeatable results. There also exists a need in the art for reducing or minimizing the effects of the various sources of error on the adjustment screw clearance.

SUMMARY OF THE INVENTION

The present invention is directed toward removing or minimizing the above-noted problems in the art and toward providing an improved method and device for setting tappet screw clearance. The present invention is further directed toward a method for setting tappet clearance that removes or minimizes the effects of major sources of error to provide more consistent and accurate results.

The method according to a first embodiment of the present invention includes determining a pre-zero point of the valve at an assumed valve-seated position, advancing the tappet screw toward the valve, contacting the valve with the tappet screw and moving the valve away from the assumed valve-seated position a predetermined distance, reversing the tappet screw to move the valve toward the assumed valve-seated position, and establishing at least one imaginary zero point while moving the valve toward the assumed valve-seated position. The imaginary zero point is in a band of linear displacement of the valve between the predetermined distance and the assumed valve-seated position. A predetermined linear travel of the valve from the pre-zero point to the imaginary zero point is assumed, and the further linear travel of the tappet screw necessary to provide the desired clearance distance is determined based upon the predetermined linear travel and the desired clearance distance. Then, the tappet screw is moved an amount equal to the determined further linear travel to place the tappet screw at the desired clearance distance from the valve.

The method according to a second embodiment of the present invention includes providing a desired clearance distance between the tappet screw and the valve, assuming a valve-seated position, advancing the tappet screw toward the valve, contacting the valve with the tappet screw and moving the valve away from the assumed valve-seated position a predetermined distance, reversing the tappet screw to move the valve toward the assumed valve-seated position, measuring plural valve displacement values while moving the valve toward the assumed valve-seated position. A plurality of averages are calculated from the plural valve displacement values, and a true zero point is determined based upon the calculated averages. The tappet screw is then moved from the determined true zero point a linear distance equal to the desired clearance distance to set the tappet clearance.

The method according to a third embodiment of the present invention includes directly contacting a measuring device with the valve head on an underside of the cylinder head. The measuring device is operable to measure a position of the valve head relative to the cylinder head. The tappet screw is rotated toward and into contact with the valve stem so as to move the valve head away from the cylinder head. A position of the valve head is measured as the valve head moves relative to the cylinder head. The direction of tappet screw rotation is reversed to move the valve head toward the cylinder head, and the true zero point of the valve head is determined based upon the measured valve head position. Then the tappet screw is further rotated to move the tappet screw a predetermined distance from the valve stem to establish the clearance distance and thereby set the tappet clearance.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
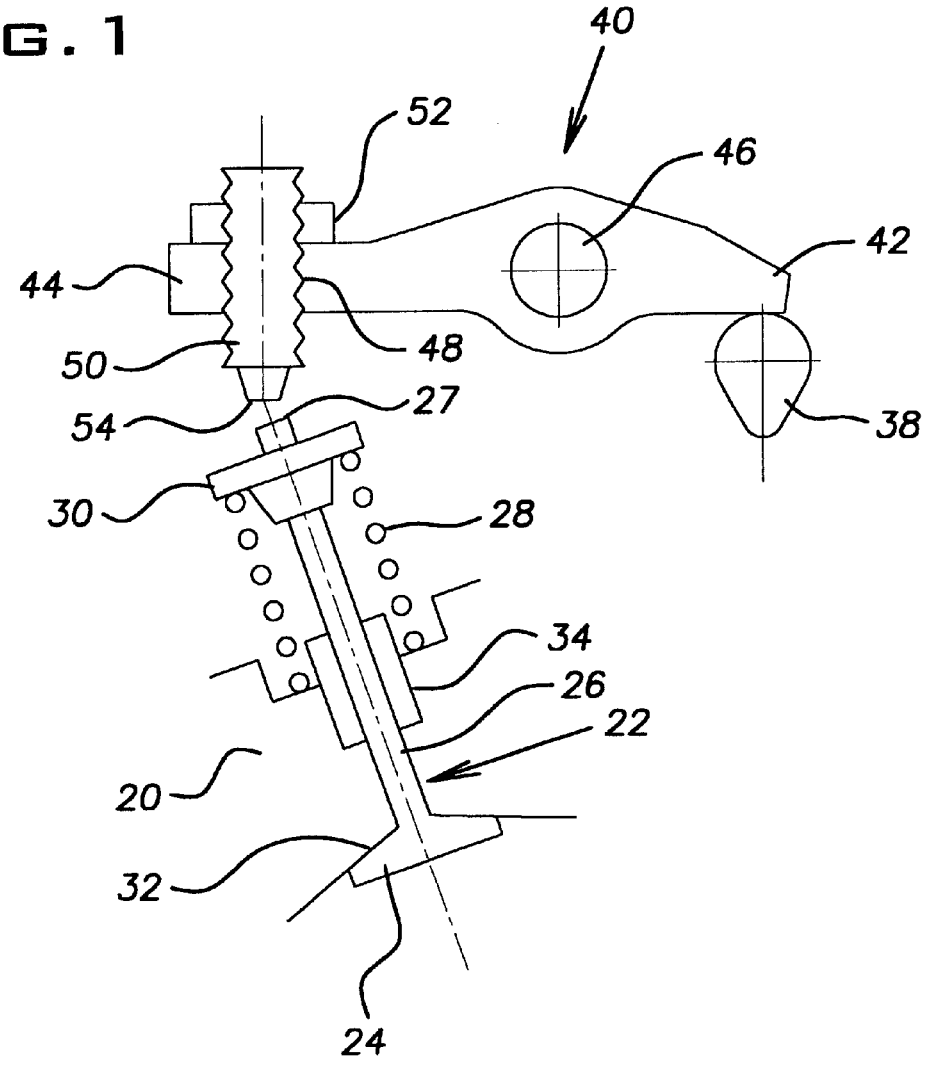
FIG. 1 schematically illustrates an engine valve actuation system.

An engine generally includes a cylinder block (not shown) on which a cylinder head 20 is mounted. The cylinder head 20 has a plurality of intake and exhaust valves 22 disposed therein. With reference to FIG. 1, each valve 22 includes a valve head 24, a valve stem 26, a valve spring 28, and a valve retainer 30. The valve head 24 is biased, by the valve spring 28, toward a closed position in engagement with a seat 32 provided on the cylinder head 20. The valve stem 26 extends from the valve head 24 and through a valve guide 34 in the cylinder head 20. The valve retainer 30 is disposed on an end of the valve stem 26 opposite the valve head 24. The valve spring 28 surrounds the valve stem 26 and is captured between the valve retainer 30 and an outer surface of the cylinder head 20.

The cylinder head 20 also carries components that serve to controllably open and close the valves 22 in an ordered fashion. The components include a multi-lobe cam shaft 38 and a series of rocker arms 40, each rocker arm 40 being associated with one of the valves 22.

With continued reference to FIG. 1, each rocker arm 40, which includes a cam shaft end 42 and a valve end 44, is pivotally secured to a rocker arm shaft 46 that defines an axis of rocker arm rotation. The valve end 44 of the rocker arm 40 has a tapped hole 48 that threadably receives a tappet or adjustment screw 50. As the cam shaft 38 rotates, the rocker arm 40 pivots about its axis of rotation, and drives the tappet screw 50 into and out of engagement with the valve stem 26, thereby opening and closing the valve 22.

The tappet screw 50 has a tappet nut 52 thereon. After the tappet screw 50 is in a desired position or spacing relative to the valve stem 26, the tappet nut 52 is tightened to prevent unintended rotation of the tappet screw 50 relative to the rocker arm 40. Preferably, the tappet screw 50 has a very fine thread pitch to permit precise adjustment of the position of the lower end of the tappet screw 50 and, hence, tappet clearance. Rotation of the tappet screw 50 varies the spacing between a lower or engagement end 54 of the tappet screw 50 and an upper or engaged surface 27 of the valve stem 26, as will be described more fully hereinafter. Typically, setting of the tappet clearance is one of the final steps in engine assembly, and is performed with the cylinder head 20 installed on the cylinder block.

Figure 2:
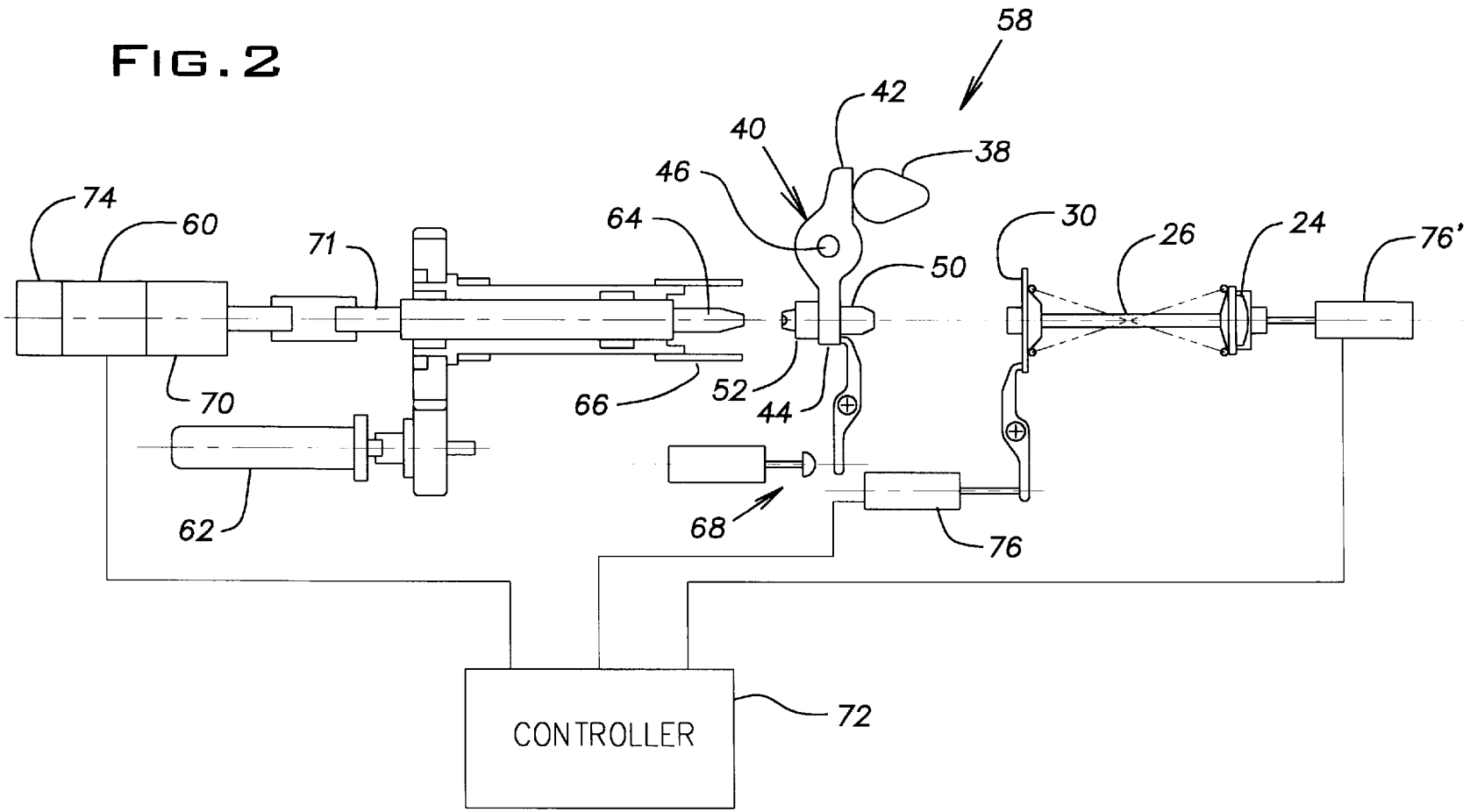
FIG. 2 schematically illustrates a tappet setting machine according to the present invention.

With reference to FIG. 2, a tappet clearance setting machine 58 used to perform the method of the present invention is schematically illustrated. The machine 58 includes a tappet screw adjustment motor 60, a tappet nut tightening motor 62, a tappet screw adjustment bit 64, a tappet nut tightening socket 66, a rocker arm clamping device 68, a sensor, such as a linear variable differential transformer 76, for measuring movement of the valve retainer 30, and a controller 72. A brake 74 for stopping and holding the tappet screw adjustment motor 60 and tappet screw adjustment bit 64 in a desired position, for example during tightening of the tappet nut 52, is also provided.

The tappet screw adjustment bit 64 is rotatably driven in both directions by the tappet screw adjustment motor 60, which is preferably a servo-motor. The tappet screw adjustment motor 60 is connected to the tappet screw adjustment bit 64 via a gear reducer 70 and shaft 71, thereby permitting the bit 64 to be driven at different rotational speeds. The tappet nut tightening socket 66 is driven by the tappet nut tightening motor 62, which is preferably a DC motor. The rocker arm clamping device 68 is operable to maintain the rocker arm cam shaft end 42 in engagement with the cam shaft 38 during setting of the tappet clearance. Such a clamping device 68 may either push the rocker arm valve end 44 upwardly, as illustrated, or push the rocker arm cam shaft end 42 downwardly.

The controller 72 receives information from various sources, such as a torque transducer (measuring tightening torque applied to the tappet nut 52), cam shaft sensor (measuring cam shaft position and rotation), and position sensor(s) such as linear variable differential transformers (hereinafter LVDT), and controls operation of the machine 58 in a predetermined manner according to the method of the present invention, to be described hereinafter. In FIG. 2, two LVDT 76, 76' are illustrated, although preferably only one LVDT is used at any given time. The first LVDT 76 is operable to sense movement of the valve retainer 30 and is preferred when the cylinder head 20 is mounted on the cylinder block. Setting tappet clearance using measurements from the first LVDT 76 is described hereinafter as it relates to the first and second preferred methods. The second LVDT 76' is operable to directly sense movement of the valve head 24, and is preferred if the tappet clearance is set prior to placement of the cylinder head 20 on the cylinder block. Setting the tappet clearance using measurements from the second LVDT 76' is described hereinafter as it relates to the third preferred embodiment.

As noted hereinbefore, several tolerances or physical variables present in the valve actuation and tappet setting machine have, heretofore, made it difficult to automatically set the tappet clearance at d desired value. These tolerances or physical variables include the journal clearance between the rocker arm 40 and the rocker shaft 46, friction coefficients between the tappet screw 50 and the rocker arm 40 and between the tappet screw 50 and the valve stem 26, thread pitch accuracy for the tappet screw 50, stop position accuracy for the tappet screw adjustment motor 60, backlash of the tappet screw adjustment motor 60, backlash between the tappet screw 50 and the rocker arm 40, rotation of the tappet screw 50 while tightening the tappet nut 52, lost motion between the tappet screw 50 and the tappet screw bit 64, and measuring device accuracies.

Figure 3:
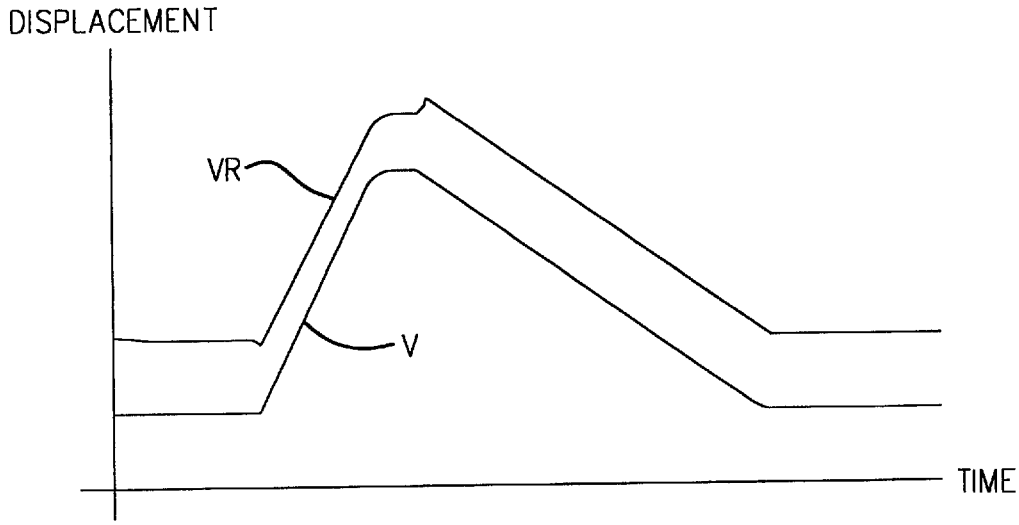
FIG. 3 is a graph illustrating relative movement of a valve retainer and a valve.

It has traditionally been proposed to measure movement of the valve retainer 30 and correlate movement of the valve retainer 30 to movement of the valve head 24. This traditional approach is based upon the assumption that the valve 22 and valve retainer 30 always move in equal amounts. However, it has been found that this assumption is not entirely correct. Rather, it is believed that, since the tappet screw 50 is not aligned with the longitudinal axis of the valve 22 (see FIG. 1), and since there is clearance between the valve stem 26 and the valve guide 34, valve retainer movement is initially staggered at opening and closing (i.e., when there is initial movement or a change in direction of movement) such that valve retainer movement does not track valve movement during portions of the valve stroke. This situation is illustrated in FIG. 3, wherein movement of the valve retainer 30 is labelled VR and movement of the valve head 24 is labelled V.

It is noted that there are periods of linear movement during opening and closing of the valve 22 wherein the valve retainer 30 and the valve head 24 move equal amounts, and it may seem apparent that either of these periods of linear movement may be used to determine the amount of tappet screw adjustment necessary to properly set the tappet clearance. However, it has been found that the determination based upon the linear period during valve closing is preferred, and reduces errors created by component tolerances. For example, since there is clearance between the tappet screw 50 and the tappet screw bit 64, there is lost motion when the driven direction of the screw 50 and bit 64 is reversed. However, since the bit 64 is maintained in the same engagement orientation with respect to the tappet screw 50 when the valve 22 is closed and when the tappet nut 52 is tightened, errors resulting from this lost motion are avoided. Therefore, using the linear period during valve closing for tappet clearance calculations removes at least this source of error.

Figure 4:
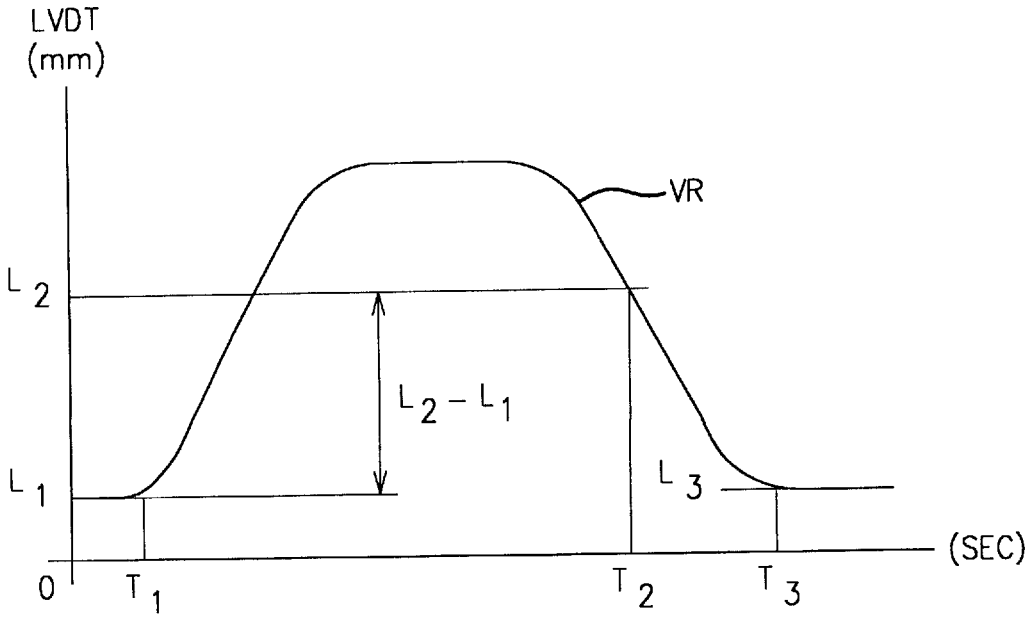
FIG. 4 is a graph illustrating valve retainer movement and measurements according to a first preferred embodiment of the present invention.
Figure 5:
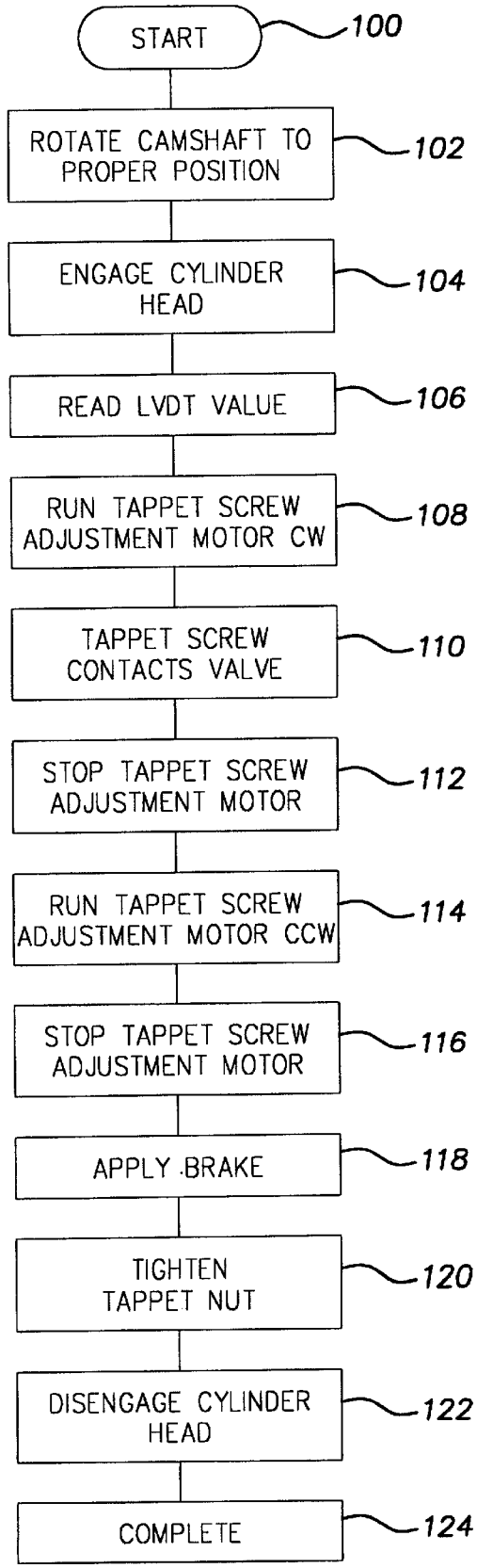
FIG. 5 is a flow chart illustrating method steps according to the first embodiment.

With reference to FIGS. 4–5, a method for setting tappet clearance according to a first preferred embodiment of the present invention is illustrated.

With reference to FIG. 4, a graph illustrating movement of the valve retainer 30 during opening and closing of the valve 22 as measured by the LVDT 76 is provided. In the graph, $L_1$ is an initial measured value at time $T_1$ before the valve retainer 30 begins to move and in which it is assumed that the valve head 24 is engaged with the seat 32, $L_2$ is a predetermined value at time $T_2$ during valve closing, and $L_3$ is a measured value at time $T_3$ when the valve 22 is closed. As used hereinafter, $L_1$ is the pre-zero point, $L_2$ is the predetermined imaginary zero point, and $L_3$ is the true zero point. The predetermined imaginary zero point is a set linear distance from the pre-zero point and is selected to fall within the linear period during valve closing wherein valve retainer travel corresponds with valve travel.

Linear travel of the tappet screw 50 from the imaginary zero point to provide the desired tappet clearance is expressed by the equation:

$$T_C = L_2 - L_1 + l_c; \quad (1)$$

wherein $l_c$ is a predetermined, known quantity equal to the tappet screw linear travel from the true zero point necessary to provide desired clearance between the tappet screw 50 and the valve stem 26. Therefore, since the imaginary zero point (predetermined) and pre-zero point (measured) are known, the linear travel $T_C$ to provide the desired tappet clearance can be calculated.

With reference to FIG. 5, a flow chart illustrating implementation of a first preferred method according to the present invention is provided. When the tappet clearance setting process is initiated (step 100), the cam shaft 38 is rotated to the proper position (step 102) wherein the base circle of the lobed cam shaft 38 is oriented for engagement with the cam shaft end 42 of the rocker arm 40. For example, in a four cylinder engine the proper position may be: cylinder one at top dead center position, cylinder two at a three-o'clock position, cylinder three at a nine-o'clock position, and cylinder four at a six-o'clock position.

Thereafter, the cylinder head 20 is engaged (step 104), which means that the tappet screw adjustment bit 64 and tappet nut tightening socket 66 are engaged with the tappet screw 50 and tappet nut 52, respectively, the clamping device 68 is forcing the cam shaft end 42 of the rocker arm 40 into engagement with the base circle of the cam shaft 38, and the LVDT 76 is positioned to measure movement of the valve retainer 30. Then, the LVDT value is read and stored by the controller 72 as the pre-zero point ($L_1$) (step 106). The tappet screw adjusting motor 60 is then run in a clockwise direction to drive the tappet screw 50 toward the valve stem 26 (step 108). The motor speed is preferably set at a first speed setting of about 30 rpm.

The tappet screw 50 contacts the valve stem 26 and the LVDT 76 measures valve retainer 30 movement (step 110). When the LVDT measurement equals a predetermined value, preferably about 0.5 mm from the pre-zero point ($L_1$), the controller sends a stop signal to the tappet screw adjusting motor 60 (step 112). Thereafter, the tappet screw adjusting motor 60 is reversed (step 114), and runs counterclockwise at a reduced, second speed setting, preferably about 10 rpm.

When the controller 72 determines, based upon the signals from the LVDT 76, that the predetermined imaginary zero point ($L_2$) has been reached, measurement of the tappet screw adjusting motor counterclockwise angle begins. Such measurement may be provided by a conventional encoder (not shown). The controller 72 stops the tappet screw adjusting motor 60 (step 116) when the measured counterclockwise angle satisfies the equation:

$$\text{counterclockwise angle} = (360^\circ/\text{pitch}) * T_C; \quad (2)$$

wherein pitch is the tappet screw thread pitch measured in linear travel per rotation, and $T_C$ is found using equation (1) above.

Thereafter, the controller activates the brake 74 (step 118) to lock the tappet screw 50 and adjustment bit 64 in position, and the tappet nut motor 62 is operated to tighten the tappet nut 52 a desired amount (step 120). The cylinder head 20 is disengaged (step 122), which means that the tappet screw adjustment bit 64 and tappet nut socket 66 are released from the tappet screw 50 and the tappet nut 52, respectively, the clamping device 68 releases the cam shaft end 42 of the rocker arm 40 from engagement with the cam shaft 38, and the LVDT 76 is disengaged from the valve retainer 30. The tappet clearance setting procedure for the valve 22 is complete (step 124).

Figure 6:
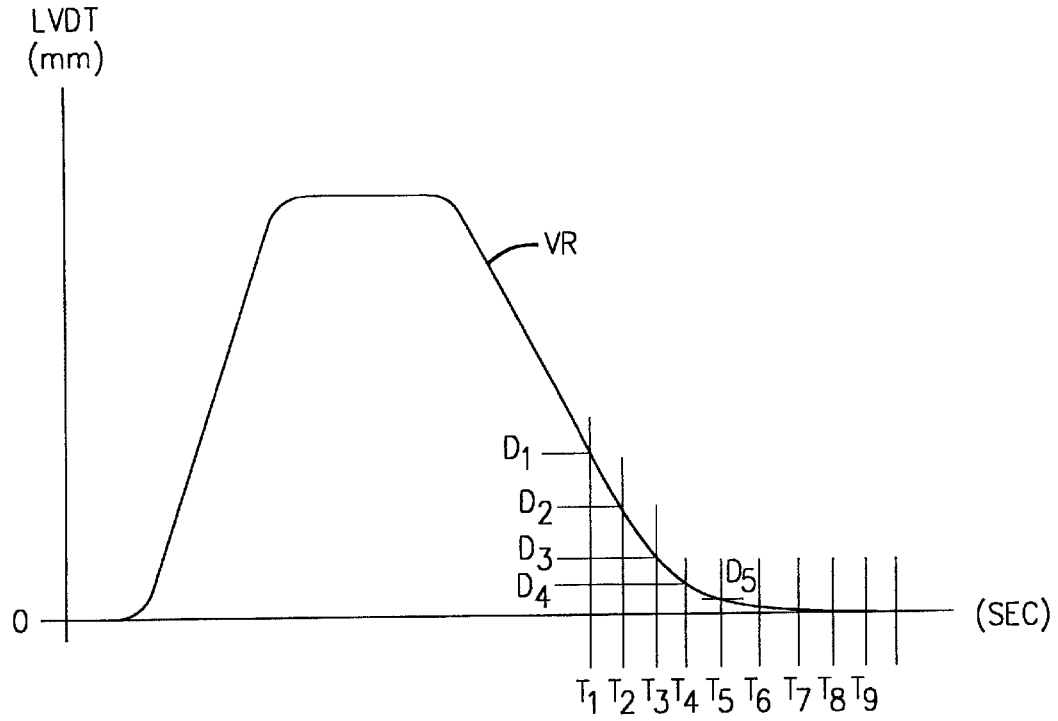
FIG. 6 is a graph illustrating valve retainer movement and measurements according to a second preferred embodiment of the present invention.
Figure 7:
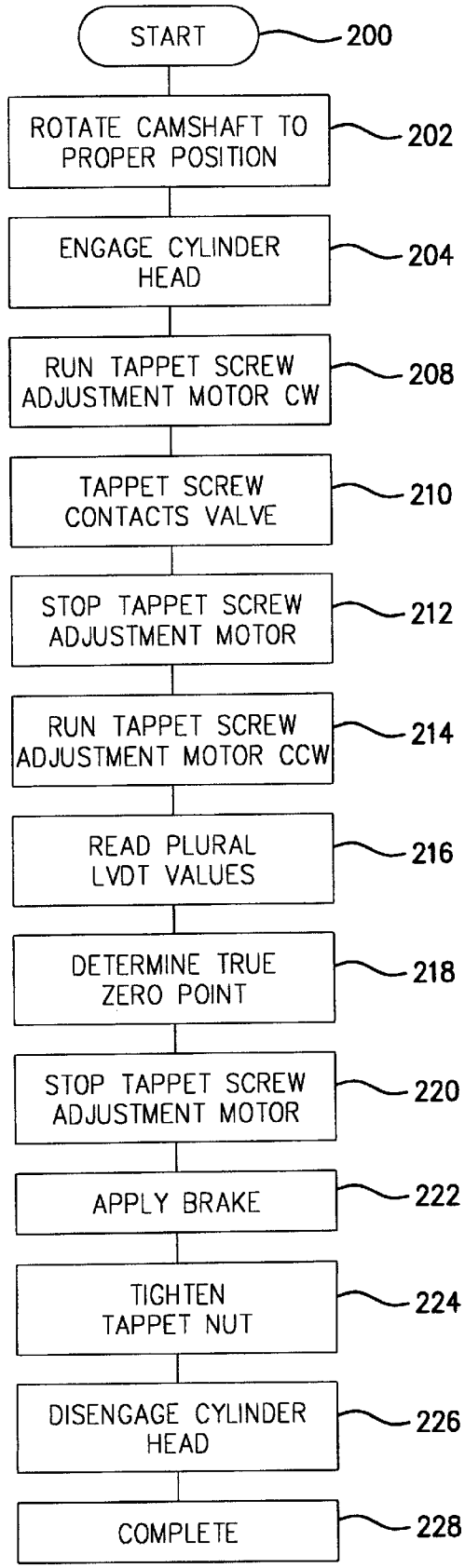
FIG. 7 is a flow chart illustrating method steps according to the second embodiment.

With reference to FIGS. 6–7, a method for setting tappet clearance according to a second preferred embodiment of the present invention is illustrated.

With reference to FIG. 6, a graph illustrating the second preferred embodiment of the method according to the present invention is provided. The second embodiment varies from the first embodiment described hereinbefore in that instead of using the imaginary zero point ($L_2$) for calculation of the tappet clearance, a plurality of measurements are taken and used to determine the true zero point ($L_3$). The second embodiment removes problems that may be encountered in the first embodiment due to machine vibration and contamination, which may result in an incorrect calculation of tappet clearance.

In accordance with the second preferred embodiment, calculations are made to derive a series of average values, wherein:

$$T_N{:}T_1, T_2, T_3 \ldots T_N(T_N-T_{N-1}=\text{constant});$$

$$D_N{:}D_1, D_2, D_3 \ldots D_N;$$

$$A_1=(D_1+D_2+D_3)/3;$$

$$A_2=(D_2+D_3+D_4)/3;$$

$$A_N=(D_N+D_{N+1}+D_{N+2})/3;$$

$$A_1-A_2=\Delta A_{1\text{-}2};$$

$$A_2-A_3=\Delta A_{2\text{-}3};$$

$$A_N-A_{N+1}=\Delta A_{N-(N+1)}.$$

Accordingly, a series of average values ($A_N$) are calculated from the measured LVDT values ($D_N$), and the true zero point is determined when the difference between adjacent average values ($\Delta A_{N-(N+1)}$) equals zero. This calculated true zero point is then used, according to the second preferred embodiment, to set the tappet clearance. More specifically, in accordance with the second preferred embodiment, once the true zero point is calculated, measurement of the tappet screw adjusting motor counterclockwise angle begins. The tappet screw adjusting motor 60 is stopped when the measured counterclockwise angle satisfies the equation:

$$\text{counterclockwise angle}=(360°/\text{pitch})*l_C; \quad (3)$$

wherein pitch is the tappet screw thread pitch measured in linear travel per rotation, and $l_C$ is the predetermined, known quantity equal to the tappet screw linear travel from the true zero point necessary to provide desired clearance between the tappet screw 50 and the valve stem 26.

Operation of the machine to perform the second preferred embodiment is similar, in many respects, to that described hereinbefore with regard to the first preferred embodiment, the steps of the second embodiment being illustrated in the flow chart of FIG. 7.

After the cycle is initiated (step 200), the cam shaft 38 is rotated to the proper position (step 202). The cylinder head 20 is engaged (step 204), which means that the tappet screw adjustment bit 64 and the tappet nut tightening socket 66 are engaged with the tappet screw 50 and the tappet nut 52, respectively, and the clamping device 68 is forcing the cam shaft end 42 of the rocker arm 40 into engagement with the base circle of the cam shaft 38. The tappet screw adjusting motor is then operated at the first speed setting to turn the tappet screw 50 clockwise (step 208) to drive the valve 22 open a predetermined amount (step 210). The tappet screw adjusting motor 60 is then stopped (step 212), and reversed (step 214) to turn the tappet screw 50 counterclockwise (closing the valve 22) at the second, slower speed setting. Plural LVDT measurements are read by the controller 72 (step 216). A plurality of averages are calculated, and deviations between consecutive calculated averages, as described above, are calculated until the true zero point is determined (step 218). Thereafter, the measurement of the tappet screw adjusting motor counterclockwise angle begins. Such measurement may be provided by a conventional encoder (not shown). The controller 72 stops the tappet screw adjusting motor 60 (step 220) when the measured counterclockwise angle satisfies equation (3) above.

Thereafter, the controller 72 activates the brake 74 (step 222) to lock the tappet screw 50 and adjustment bit 64 in position, and the tappet nut motor 62 is operated to tighten the tappet nut 52 a desired amount (step 224). The cylinder head 20 is then disengaged (step 226) and the tappet clearance setting procedure for the valve according to the second embodiment of the present invention is complete (step 228).

In the previously-described first and second embodiments, the tappet clearance is determined based upon measured movement of the valve retainer 30 (using the first LVDT 76 illustrated in FIG. 1), which is necessary when the cylinder head 20 is mounted on the cylinder block. However, in accordance with a third embodiment of the present invention, tappet clearance is determined before the cylinder head 20 is mounted to the cylinder block. The third embodiment, therefore, permits direct measurement of the movement of the valve head 24 using the second LVDT 76' and, it is believed, provides a better indication of the valve condition (open/closed) and possibly more accurate results.

Figure 8:
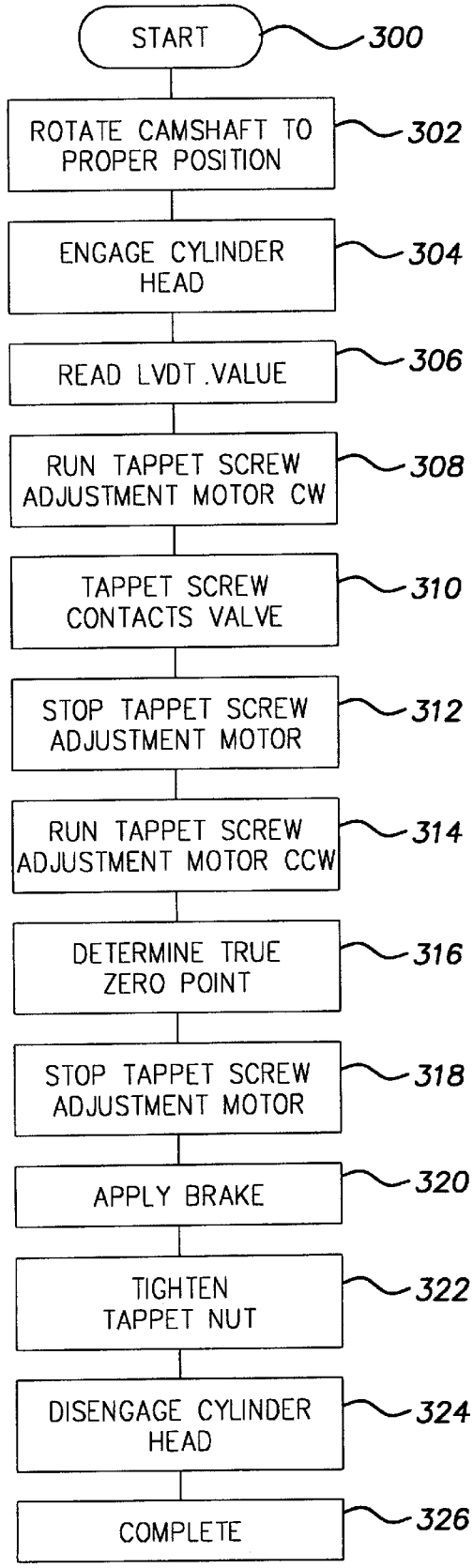
FIG. 8 is a flow chart illustrating method steps according to a third preferred embodiment of the present invention.

Although the method of the first and second embodiments may also be used when the movement of the valve head 24 is directly measured, it is believed that a simpler process is facilitated by direct measurement, and is described hereinafter with reference to the flow chart of FIG. 8.

After the process is started (step 300) and the cam shaft 38 is properly oriented (step 302), the cylinder head 20 is engaged (with the LVDT 76' contacting the valve head 24—step 304), and the initial LVDT measurement is stored in the controller 72 (step 306). The tappet screw adjusting motor 60 is operated to turn the tappet screw 50 clockwise (step 308) at the first speed setting and drive the valve 22 open a predetermined amount (step 310). The tappet screw adjusting motor 60 is then stopped (step 312), and reversed to turn the tappet screw 50 clockwise (closing the valve 22—step 314) at the second, slower speed setting.

The LVDT measurements are read by the controller 72 and compared to the stored initial LVDT measurement to determine the true zero point (i.e., when LVDT measurement equals initial LVDT measurement). Alternatively, the true zero point is determined when consecutive LVDT measurements have the same value (i.e., when there is no difference between consecutive LVDT measurements). In either case, after the true zero point is determined (step 316), measurement of the tappet screw adjusting motor counterclockwise angle begins. The controller 72 stops the tappet screw adjusting motor 60 (step 318) when the measured counterclockwise angle satisfies equation (3) above.

Thereafter, the controller activates the brake 74 (step 320) to lock the tappet screw 50 and adjustment bit 64 in position, and the tappet nut motor 62 is operated to tighten the tappet nut 52 a desired amount (step 322). The cylinder head 20 is then disengaged (step 324) and the tappet clearance setting procedure for the valve is complete (step 326).

Setting the tappet clearance prior to placement of the cylinder head 20 on the cylinder block also provides the added advantage that an overall quality check of the tappet clearance settings for the engine can be performed after all the tappet screws 50 are set using the third embodiment of the present invention. Such a quality check would involve equipment providing an LVDT 76' for each valve 22 (preferably sensing valve head movement), means for rotating the cam shaft 38, means for measuring/detecting the rotational angle of the cam shaft 38, and control means for correlating cam shaft angle to valve position. With such equipment, the cam shaft 38 can be slowly rotated and, since the rotational angle of the cam shaft 38 at which each valve 22 should open and close is known, the valves movement can be quickly checked to determine if they do, in fact, open and close at the correct rotational angle of the cam shaft 38. If there is some discrepancy between the desired valve opening/closing operation and the actual opening/closing operation, a quick adjustment and re-test of the system can be performed to ensure the quality of the entire engine valve system. Therefore, the third embodiment of the present invention facilitates checking the tappet clearance setting, and thereby provides more precise, repeatable, and accurate final tappet clearance settings.

Figure 9:
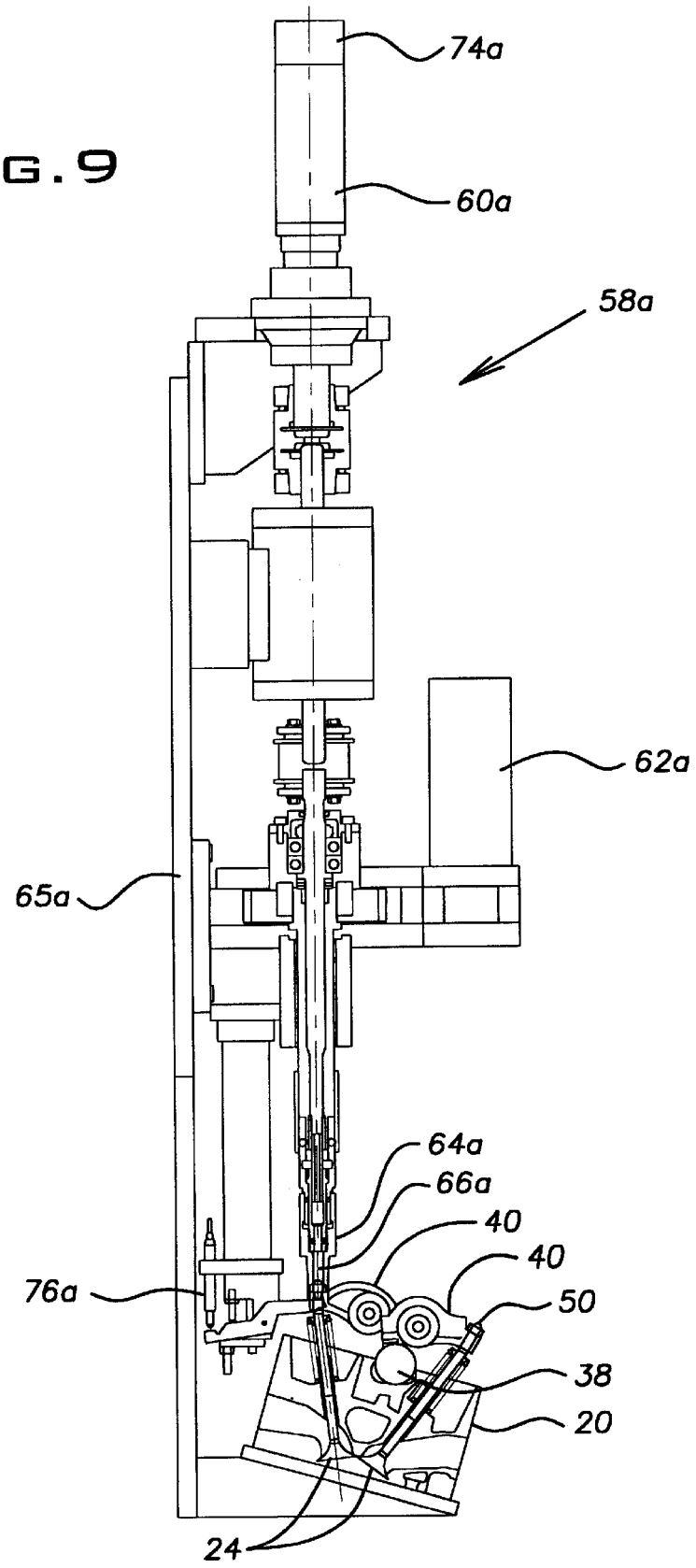
FIG. 9 is an elevational view of a machine for practicing the first and second embodiments of the present invention; and, FIG. 10 is an elevational view of a machine for practicing the third embodiment of the present invention.

With reference to FIG. 9, a machine 58*a* for performing the first and second embodiments of the present invention is shown in more detail.

It is noted that this machine 58*a* is illustrated in conjunction with a cylinder head 20. The cylinder block, which is present, is not illustrated. The machine 58*a* includes a tappet screw adjustment motor 60*a*, a tappet nut tightening motor 62*a*, a tappet screw adjustment bit 64*a*, a tappet nut tightening socket 66*a*, a rocker arm clamping device (not shown), a sensor, such as a linear variable differential transformer 76*a*, for measuring movement of the valve retainer 30, and a controller (not shown). A brake 74*a* for stopping and holding the tappet screw adjustment motor 60*a* and tappet screw adjustment bit 64*a* in a desired position, for example during tightening of the tappet nut 52, is also provided.

The motors 60*a*, 62*a*, and associated adjustment bit 64*a* and tightening socket 66*a* are preferably mounted upon a slide 65*a* to permit coordinated movement vertically toward and away from the tappet screw 50 and tappet nut 52. The clamping device and LVDT 76*a* are preferably also mounted to a slide for coordinated movement toward and away from the rocker arm 40 and the valve retainer 30. Naturally, these slides may be manually operable, or may be automatically movable into and out of operating position. For example, an engine locating probe may be provided together with a device for orienting the cam shaft 38 and thereby permit the tappet setting machine to automatically sequence through the adjustment of each of the tappet screws 50. Alternatively, an operator may manually move the machine equipment into and out of engagement with the engine components during the tappet clearance setting procedure described hereinbefore. It is believed that means for automatically positioning machine tools are well known in the art and, therefore, they will not be further discussed hereinafter.

Figure 10:
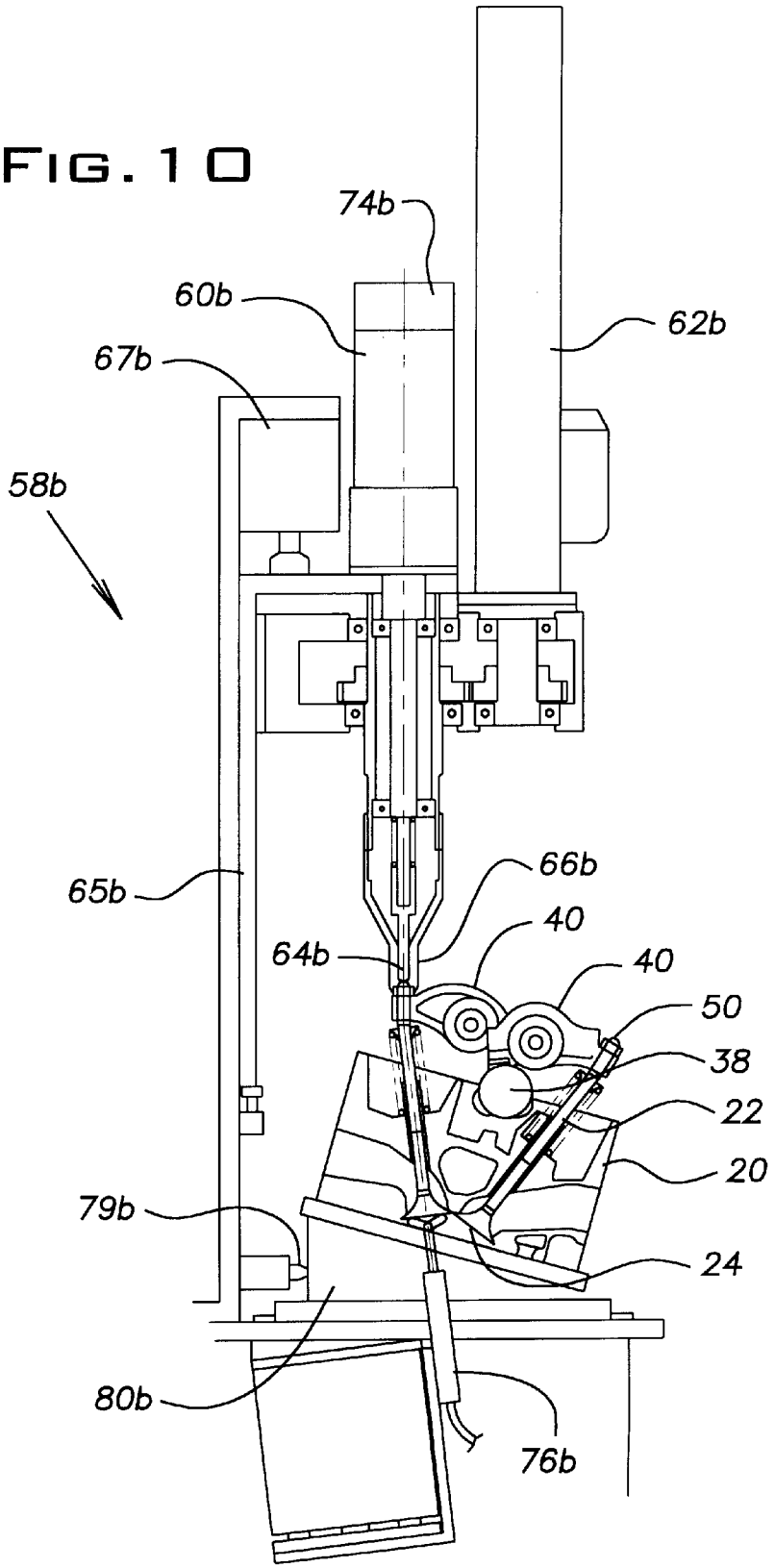

With reference to FIG. 10, a machine 58*b* for performing the third embodiment of the present invention is shown in more detail.

It is noted that this machine 58*b* is illustrated in conjunction with only the cylinder head 20 since the tappet clearance in the third method is set prior to installation of the cylinder head 20 on the cylinder block. The machine 58*b* includes a tappet screw adjustment motor 60*b*, a tappet nut tightening motor 62*b*, a tappet screw adjustment bit 64*b*, a tappet nut tightening socket 66*b*, a rocker arm clamping device (not shown), a sensor, such as a linear variable differential transformer 76*b*, for measuring movement of the valve head 24, and a controller (not shown). A brake 74*b* for stopping and holding the tappet screw adjustment motor 60*b* and tappet screw adjustment bit 64*b* in a desired position, for example during tightening of the tappet nut 52, is also provided.

The motors 60*b*, 62*b*, and associated adjustment bit 64*b* and tightening socket 66*b* are preferably mounted upon a slide 65*b* to permit coordinated movement vertically toward and away from the tappet screw 50 and tappet nut 52 by means of a slide cylinder 67*b*. The clamping device (not shown) is also preferably mounted upon its own slide and is movable separately from the motors. Alternatively, the clamping device may move vertically with the motors 60*b*, 62*b*. The LVDT 76*b* is disposed on an opposite side of the cylinder head 20 so as to access the valve head 24. The LVDT 76*b* is also preferably secured to means permitting desired movement thereof into and out of engagement with the valve head 24.

Naturally, the machine components may be moved manually, or may be automatically moved into and out of their respective operating positions. For example, a cylinder head locating probe 79*b* may be provided to engage a locating detent on a cylinder head pallet 80*b* to thereby properly position the cylinder head 20 relative to the machine. Thereafter, a device for orienting the cam shaft 38 would permit the tappet setting machine to automatically sequence through the adjustment of each of the tappet screws 50. Alternatively, an operator may manually move the equipment into and out of engagement with the engine components during the tappet clearance setting procedure described hereinbefore. It is believed that, due to the fact that both sides of the cylinder head 20 must be contacted simultaneously, which would be difficult for an operator to see, the process according to the third embodiment may be facilitated by automating the process, as described above.

While the preferred embodiment of the present invention is shown and described herein, it is to be understood that the same is not so limited but shall cover and include any and all modifications thereof which fall within the purview of the invention.

What is claimed is:

1. A method for setting a clearance between a tappet screw and an engine valve, comprising the steps of:

establishing a known cam shaft orientation;

providing a desired clearance distance between said tappet screw and said valve;

assuming a valve-seated position;

determining a pre-zero point of the valve at the assumed valve-seated position;

advancing the tappet screw toward the valve;

contacting the valve with the tappet screw and moving the valve away from the assumed valve-seated position a predetermined distance;

reversing the tappet screw to move the valve toward the assumed valve-seated position;

establishing at least one imaginary zero point while moving the valve toward the assumed valve-seated position, said imaginary zero point falling in a band of linear displacement of the valve between said predetermined distance and said assumed valve-seated position;

assuming a predetermined linear travel of the valve from the pre-zero point to the imaginary zero point;

determining further linear travel of the tappet screw necessary to provide the desired clearance distance based upon the predetermined linear travel and the desired clearance distance; and, moving the tappet screw an amount equal to the determined further linear travel to place the tappet screw at the desired clearance distance from said valve.

2. The method according to claim 1, wherein the further linear travel of the tappet screw is determined based upon a pitch of the tappet screw and the sum of the predetermined linear travel and the desired clearance distance.

3. The method according to claim 2, wherein a measuring device is in engagement with a valve retainer, and measured valve displacement values are based upon valve retainer movement.

4. A method according to claim 1, comprising the further step of providing a cylinder head separated from an engine, said cylinder head having a rocker arm secured thereto and having said valve extending therethrough, said rocker arm including said tappet screw and said valve including a valve head, wherein a measuring device is in direct contact with said valve head and is operable to measure movement of said valve head relative to said cylinder head.

5. The method according to claim 4, wherein the further linear travel of the tappet screw is determined based upon a pitch of the tappet screw and the sum of the predetermined linear travel and the desired clearance distance.

6. A method for setting a clearance between a tappet screw and an engine valve, comprising the steps of:

establishing a known cam shaft orientation;

providing a desired clearance distance between said tappet screw and said valve;

assuming a valve-seated position;

advancing the tappet screw toward the valve;

contacting the valve with the tappet screw and moving the valve away from the assumed valve-seated position a predetermined distance;

reversing the tappet screw to move the valve toward the assumed valve-seated position;

measuring plural valve displacement values while moving said valve toward the assumed valve-seated position;

calculating a plurality of averages from said plural valve displacement values;

determining a true zero point based upon said calculated averages;

moving the tappet screw from said determined true zero point a linear distance equal to the desired clearance distance.

7. The method according to claim 6, wherein the true zero point is determined when a difference between consecutive calculated averages is zero.

8. The method according to claim 7, wherein a measuring device is in engagement with a valve retainer, and the measured valve displacement values are based upon valve retainer movement.

9. The method according to claim 6, Wherein said linear distance is based upon a pitch of the tappet screw and the desired clearance distance.

10. The method according to claim 9, wherein the true zero point is determined when a difference between consecutive calculated averages is zero.

11. The method according to claim 10, wherein a measuring device is in engagement with a valve retainer, and the measured valve displacement values are based upon valve retainer movement.

12. A method for setting a clearance distance between a tappet screw and an engine valve, comprising:

providing a cylinder head separated from an engine, said cylinder head having a rocker arm secured thereto and a valve extending therethrough, said rocker arm including a tappet screw and said valve including a valve stem and a valve head;

establishing a known cam shaft orientation;

placing the rocker arm in contact with said cam shaft, directly contacting a measuring device with the valve head on an underside of the cylinder head, said measuring device being operable to measure a position of the valve head relative to the cylinder head;

rotating the tappet screw toward and into contact with the valve stem so as to move the valve head away from the cylinder head;

measuring a position of the valve head as said valve head moves relative to the cylinder head;

reversing the direction of tappet screw rotation to move the valve head toward the cylinder head;

determining a true zero point of said valve head based upon said measured valve head position;

further rotating said tappet screw to move said tappet screw a predetermined distance from said valve stem to establish said clearance distance.

13. The method according to claim 12, wherein said true zero point is when said measured valve head position, while moving said valve head toward said cylinder head, is equal to an initial valve head position measured before said valve head is moved relative to said cylinder head.

14. The method according to claim 12, wherein said true zero point is when a difference between consecutive measured valve positions is zero.

* * * * *